US010987955B2

(12) United States Patent
Ito et al.

(10) Patent No.: US 10,987,955 B2
(45) Date of Patent: Apr. 27, 2021

(54) PRINTER

(71) Applicant: BROTHER KOGYO KABUSHIKI KAISHA, Nagoya (JP)

(72) Inventors: Tsuyoshi Ito, Nagoya (JP); Masao Mimoto, Nagoya (JP); Aya Kimura, Yokohama (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 15/865,968

(22) Filed: Jan. 9, 2018

(65) Prior Publication Data

US 2018/0281473 A1 Oct. 4, 2018

(30) Foreign Application Priority Data

Mar. 31, 2017 (JP) ..... JP2017-072098

(51) Int. Cl.
*B41J 11/46* (2006.01)
*B41J 13/10* (2006.01)
*B41J 11/00* (2006.01)

(52) U.S. Cl.
CPC ..... *B41J 11/46* (2013.01); *B41J 11/008* (2013.01); *B41J 13/103* (2013.01); *B41J 13/106* (2013.01)

(58) Field of Classification Search
None
See application file for complete search history.

(56) References Cited

U.S. PATENT DOCUMENTS 6,106,095 A * 8/2000 Jackson ..... B41J 2/2135 347/19
6,439,684 B1 8/2002 Yoshimura et al.
6,769,759 B2 * 8/2004 Yamasaki ..... B41J 2/15 347/19

(Continued)

FOREIGN PATENT DOCUMENTS

JP 2000-153660 A 6/2000
JP 2007-185944 A 7/2007
JP 2011-051182 A 3/2011

OTHER PUBLICATIONS

Notice of Reasons for Refusal dated Feb. 2, 2021 received in Japanese Patent Application No. JP 2017-072098 together with an English language translation.

*Primary Examiner* — Alejandro Valencia
(74) *Attorney, Agent, or Firm* — Scully Scott Murphy and Presser

(57) ABSTRACT

A printer includes a first roller, a second roller, a motor and a head. The printer includes a controller configured to control the head and the motor to print a first pattern comprising a plurality of first pattern elements on the sheet by alternately repeating, ejecting a liquid droplet to print one of the first pattern elements on the sheet and conveying a sheet in a conveyance direction by a first distance. The controller is configured to, after printing the first pattern on the sheet, control the motor to convey the sheet in the conveyance direction by a second distance and control the head to eject the liquid droplet to print a second pattern on the sheet without conveying the sheet, a respective first pattern element and a corresponding second pattern element being disposed at a same location in a direction orthogonal to the conveyance direction.

23 Claims, 18 Drawing Sheets

(56) References Cited

U.S. PATENT DOCUMENTS

| | | | | |
|---|---|---|---|---|
| 8,235,492 | B2 * | 8/2012 | Saito | B41J 11/42 347/16 |
| 8,277,010 | B2 * | 10/2012 | Yoshida | B41J 29/393 347/14 |
| 2007/0140771 | A1 | 6/2007 | Yanagi | |
| 2012/0007917 | A1 * | 1/2012 | Uchida | B41J 11/425 347/37 |

* cited by examiner

PRINTER

CROSS-REFERENCE TO RELATED APPLICATION

This application claims priority from Japanese Patent Application No. 2017-072098 filed on Mar. 31, 2017, the content of which is incorporated herein by reference in its entirety.

FIELD OF DISCLOSURE

The present invention relates to a printer.

BACKGROUND

There is known a printer that determines conveyance error of a sheet by forming test patterns on the sheet. A test pattern forming method is known in which a first pattern is formed on the sheet, the sheet is minutely conveyed and a second pattern is formed on the sheet, which is repeatedly performed. Conveyance error is determined based on overlapping of the second pattern formed each time minute conveying is performed, and the first pattern.

In a well-known printer, power from a motor is transmitted to rollers, and the sheet is conveyed by rotation of the rollers. Multiple gears are included in a power transmission mechanism from the motor to the rollers, and there is backlash between adjacent gears.

Although determination of conveyance error of the sheet based on test patterns intends to determine conveyance error primarily due to roller structure, the conveyance error of the sheet during minute-distance conveyance due to this backlash makes the conveyance error due to roller structure difficult to discern. Examples of conveyance error due to roller structure include conveyance error due to roller eccentricity and conveyance error due to outer shapes of rollers.

It has been found desirable to provide a technology that suppresses influence of play in the power transmission mechanism, and enables sheet conveyance error due to roller structure to be determined by test patterns with high accuracy.

SUMMARY

A printer according to an aspect of the present disclosure includes a first roller, a second roller, and a motor configured to drive the first roller and the second roller to convey a sheet in a conveyance direction from the first roller toward the second roller. The printer includes a head disposed between the first roller and the second roller in the conveyance direction, the head comprising a plurality of nozzles aligned in the conveyance direction, the plurality of nozzles comprising a first nozzle and a second nozzle positioned in a downstream side from the first nozzle in the conveyance direction and a controller configured to control the head and the motor to print a first pattern comprising a plurality of first pattern elements on the sheet by alternately repeating, ejecting a liquid droplet from the first nozzle toward the sheet to print one of the first pattern elements on the sheet, and conveying the sheet in the conveyance direction by a first distance. The controller is configured to, after printing the first pattern on the sheet, control the motor to convey the sheet in the conveyance direction by a second distance where one of the first pattern elements of the first pattern faces the second nozzle during ejecting the liquid droplet toward the sheet and control the head to eject the liquid droplet from the second nozzle toward the sheet to print a second pattern on the sheet without conveying the sheet, a respective first pattern element and a corresponding second pattern element being disposed at a same location in a direction orthogonal to the conveyance direction.

Influence of play in the power transmission mechanism readily occurs at the initial stage of operations of repeatedly performing slight distance conveyance of the sheet. By performing slight distance conveyance once or multiple times, free spinning of the motor due to the play in the power transmission mechanism is resolved, so in subsequent slight distance conveyance, conveyance error due to play in the power transmission mechanism does not readily occur. Accordingly, performing formation of an image involving slight distance conveyance first, and subsequently performing formation of an image that does not involve slight distance conveyance, enables the influence of play in the power transmission mechanism to be suppressed, and a test pattern can be formed where conveyance error of the sheet due to the roller structure can be detected with high accuracy.

DETAILED DESCRIPTION

Exemplary embodiments will be described with reference to the drawings.

First Embodiment

Figure 1:
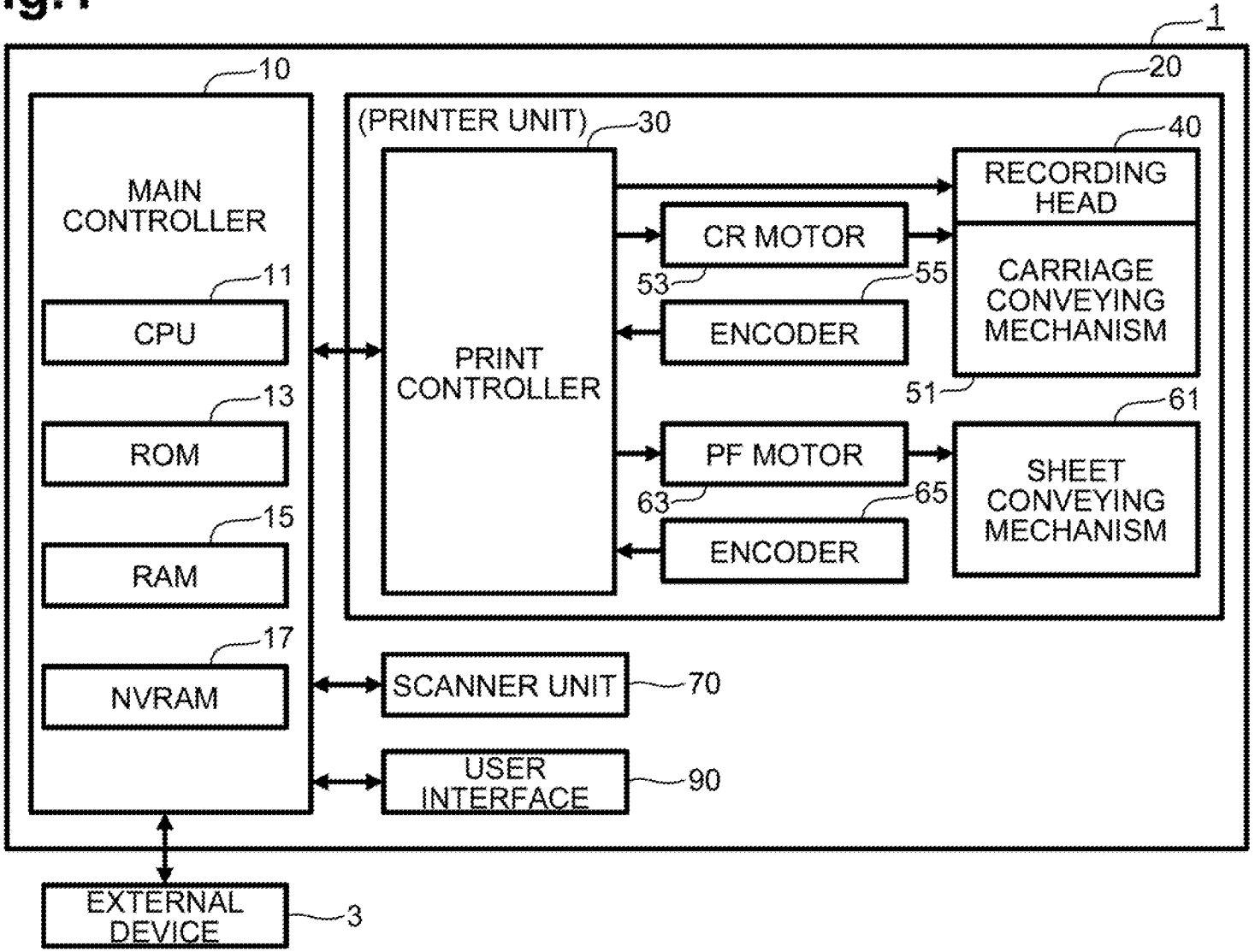
FIG. 1 is a block diagram illustrating a schematic configuration of an image forming system.

An image forming system 1 according to a first embodiment illustrated in FIG. 1 is configured as a digital multifunction printer. This image forming system 1 includes a main controller 10, a printer unit 20, a scanner unit 70, and a user interface 90. The main controller 10 centrally controls the overall image forming system 1. The main controller 10 includes a central processing unit (CPU) 11, read-only memory (ROM) 13, random access memory (RAM) 15, and non-volatile RAM (NVRAM) 17.

The CPU 11 executes processing in accordance with programs stored in the ROM 13. The RAM 15 is used as a work region when the CPU 11 executes programs. The NVRAM 17 is non-volatile memory capable of electrically rewriting data. Examples of the NVRAM 17 include flash memory and electrically erasable programmable ROM (EEPROM). The main controller 10 further includes a communication interface (omitted from illustration) that is communicable with an external device 3. An example of the external device 3 is a personal computer.

The printer unit 20 is controlled by the main controller 10 to form images on a sheet Q. The printer unit 20 is configured as an ink-jet printer. The printer unit 20 forms images on the sheet Q based on data received from the external device 3, and image data representing images of documents read by the scanner unit 70, for example. The printer unit 20 further is controlled by the main controller 10 to form test patterns on the sheet Q to determine conveyance error of the sheet Q.

The scanner unit 70 is controlled by the main controller 10 to optically read documents placed on a document table, and input image data representing the images read from the documents to the main controller 10. The user interface 90 has a display that displays various types of information of the user, and an input device for accepting instructions from the user.

In detail, the printer unit 20 includes a print controller 30, a recording head 40, a carriage conveying mechanism 51, a carriage (CR) motor 53, a linear encoder 55, a sheet conveying mechanism 61, a paper feed (PF) motor 63, and a rotary encoder 65.

The print controller 30 is configured to control discharge of ink droplets from the recording head 40, conveyance control of a carriage 52 (see FIG. 2), and conveyance control of the sheet Q, in accordance with instructions from the main controller 10.

The recording head 40 is controlled by the print controller 30 to discharge ink droplets and form images on the sheet Q. The recording head 40 has a discharge nozzle group N0 of ink droplet discharge nozzles arrayed in a sub-scanning direction, provided on a lower face thereof facing the sheet Q. The sub-scanning direction corresponds to the conveyance direction of the sheet Q, and corresponds to the Y-axis direction in FIG. 2. A main scanning direction corresponds to a direction orthogonal to the sub-scanning direction, and corresponds to the conveyance direction of the carriage 52 (the normal direction of the plane of view, i.e., the X-axis direction, in FIG. 2). The nozzle group N0 of discharge nozzles provided to the recording head 40 will hereinafter be referred to as "nozzle group N0".

The carriage conveying mechanism 51 has the carriage 52 to which the recording head 40 is mounted, and is configured to convey the carriage 52 in the main scanning direction. The CR motor 53 is the driving source of the carriage conveying mechanism 51, and is configured of a DC motor. The CR motor 53 is controlled by the print controller 30. The conveyance control of the carriage 52 is realized by the print controller 30 controlling rotations of the CR motor 53.

The linear encoder 55 inputs pulse signals, corresponding to displacement of the carriage 52 in the main scanning direction, to the print controller 30 as encoder signals. The print controller 30 detects the position and speed of the carriage 52 in the main scanning direction based on the encoder signals input from the linear encoder 55, and performs feedback control of the position and speed of the carriage 52. The print controller 30 controls the recording head 40 in conjunction with the movement of the carriage 52, and causes the recording head 40 to intermittently discharge ink droplets, thereby forming the intended image on the sheet Q.

Figure 2:
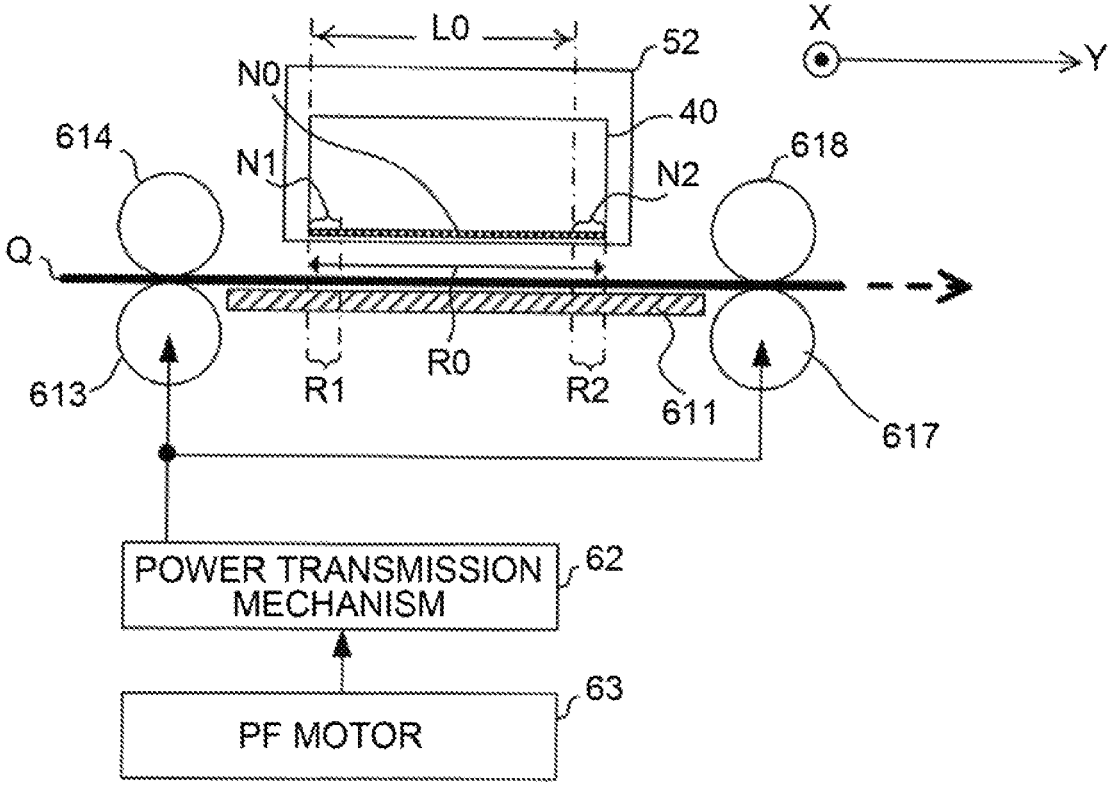
FIG. 2 is a diagram illustrating a schematic configuration of a sheet conveyance mechanism.

The sheet conveying mechanism 61 is configured to convey sheet Q from a sheet feed tray (omitted from illustration) to a discharge tray (omitted from illustration). FIG. 2 illustrates one example of a configuration around the recording head 40. In FIG. 2, a lead edge of the sheet Q has past the discharge roller 617. The sheet conveying mechanism 61 has a platen 611 below the recording head 40, as illustrated in FIG. 2. The sheet conveying mechanism 61 also includes a conveyance roller 613 and pinch roller 614 disposed facing each other, upstream from the platen 611 in the sheet conveyance direction, and a discharge roller 617 and a spur roller 618 disposed facing each other, downstream from the platen 611 in the sheet conveyance direction.

The conveyance roller 613 and discharge roller 617 are linked to the PF motor 63 via a power transmission mechanism 62, and rotate synchronously under power received from the PF motor 63. The PF motor 63 is the driving source of the sheet conveying mechanism 61, and is configured of a DC motor. The power transmission mechanism 62 includes a gear mechanism on the power transmission path between the PF motor 63 and conveyance roller 613.

The sheet conveying mechanism 61 separates the sheet Q loaded on the sheet feed tray one sheet at a time by rotation of a sheet feed roller (omitted from illustration), and provides the separated sheet Q to the nip of the conveyance roller 613 and pinch roller 614. The conveyance roller 613 is rotationally driven by the PF motor 63, and thus conveys the sheet Q supplied from the sheet feed tray downstream in the sheet conveyance direction indicated by the dashed-line arrow in FIG. 2. The conveyance roller 613 conveys the sheet Q downstream by rotation, in a state where each sheet Q is nipped between the conveyance roller 613 and pinch roller 614.

The sheet Q conveyed downstream by rotation of the conveyance roller 613 pass through a recording region R0 while being supported by the platen 611. The recording region R0 corresponds to a region below the nozzle group N0 of the recording head 40, within the conveyance path of the sheet Q. The sheet Q that has passed through the recording region R0 are nipped between the discharge roller 617 and spur roller 618 and conveyed downstream by rotation of the discharge roller 617. The sheet Q that has passed the discharge roller 617 are finally discharged to the discharge tray.

The rotary encoder 65 is provided on a rotation shaft of the PF motor 63, and inputs pulse signals corresponding to rotations of the conveyance roller 613 to the print controller 30 as encoder signals. The print controller 30 detects the rotation amount, rotation speed, and rotation phase $\phi$ of the conveyance roller 613, based on encoder signals from the rotary encoder 65. The rotation phase $\phi$ corresponds to the rotation angle $\phi$ of the conveyance roller 613.

The main controller 10 stores a control parameter group corresponding to the individual variance of the printer unit 20 in the NVRAM 17. The main controller 10 appropriately controls the printer unit 20 based on this control parameter group. Specifically, the main controller 10 sets to the print controller 30 a parameter group regulating operations of the print controller 30 based on the control parameter group stored in the NVRAM 17, and causes the print controller 30 to operate, thereby appropriately controlling the printer unit 20 such that the operations of the print controller 30 match the individual variability.

The print controller 30 executes control of the CR motor 53 and PF motor 63 based on the parameter group set by the main controller 10, based on encoder signals from the linear encoder 55 and the rotary encoder 65. This collaboration between the main controller 10 and print controller 30 realizes discharge control of ink droplets from the recording head 40, conveyance control of the carriage 52 on which is mounted the recording head 40, and conveyance control of the sheet Q, in the present disclosure.

In an aspect of the disclosure, the control parameter group that the NVRAM 17 stores includes correction parameter groups for correcting the rotation amount of the conveyance roller 613 in a direction of suppressing conveyance error of the sheet Q. The main controller 10 references these correction parameter groups to calculate a target rotation amount LS for the conveyance roller 613 that corresponds to the target sheet conveyance amount, and sets to the print controller 30 a parameter that represents the target rotation amount LS of the conveyance roller 613 that has been calculated. Sheet conveyance by the conveyance roller 613 is realized with conveyance error due to eccentricity and the outer shape and so forth of the conveyance roller 613 suppressed, due to this setting. At least part of the correction parameter groups is updated to values corresponding to the individual variance, based on test pattern formation results.

Figure 3:
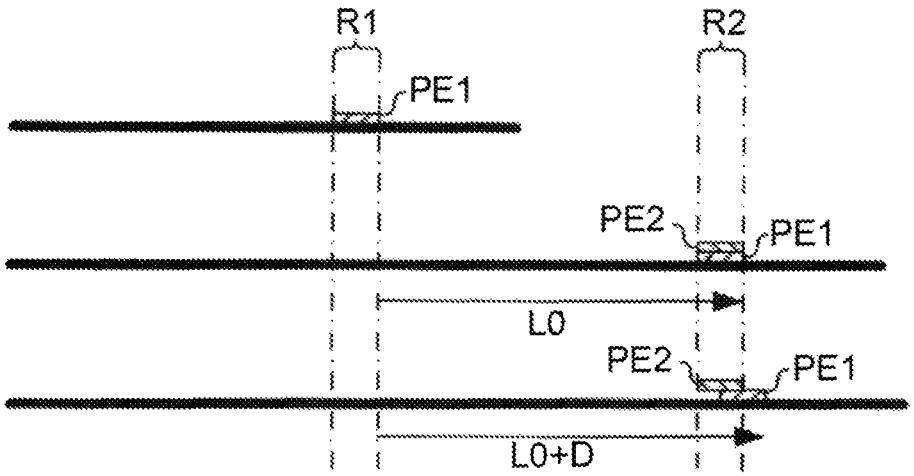
FIG. 3 is a diagram describing the relationship between overlaying pattern elements and conveyance error.

A test pattern is realized by, for example, forming a first pattern element PE1 at an upstream portion R1 of the recording region R0 using a first nozzle group N1 of the recording head 40, and forming a second pattern element PE2 at a downstream portion R2 of the recording region R0 using a second nozzle group N2 of the recording head 40, as illustrated in FIGS. 2 and 3.

Of the nozzle group N0 that the recording head 40 has, the first nozzle group N1 corresponds to a nozzle group situated at the upstream side in the sheet conveyance direction, as illustrated in FIG. 2. The upstream portion R1 of the recording region R0 corresponds to a region in the recording region R0 where image formation can be performed by the first nozzle group N1. Of the nozzle group N0, the second nozzle group N2 corresponds to a nozzle group situated at further on the downstream side in the sheet conveyance direction than the first nozzle group N1. The downstream portion R2 of the recording region R0 corresponds to a region in the recording region R0 where image formation can be performed by the second nozzle group N2.

In a case where the distance between the first nozzle group N1 and second nozzle group N2 is a distance L0, the distance between the upstream portion R1 and downstream portion R2 in the recording region R0 is the distance L0, which is a fixed distance that is geometrically determined.

Accordingly, in a case of forming the first pattern element PE1 on a sheet Q, as illustrated at the top in FIG. 3, and then conveying the sheet Q correctly by the distance L0 and forming the second pattern element PE2 on the sheet Q, the second pattern element PE2 is formed completely overlaying the first pattern element PE1 as illustrated at the middle in FIG. 3. On the other hand, in a case where the sheet Q is conveyed further than the distance L0 by a distance D regardless the PF motor 63 being controlled so as to convey the sheet Q by the distance L0, the second pattern element PE2 is formed on the sheet Q deviated from the first pattern element PE1, as illustrated at the bottom in FIG. 3. Conveyance error of the sheet Q is determined in the present embodiment from test patterns using this phenomenon.

Figure 4:
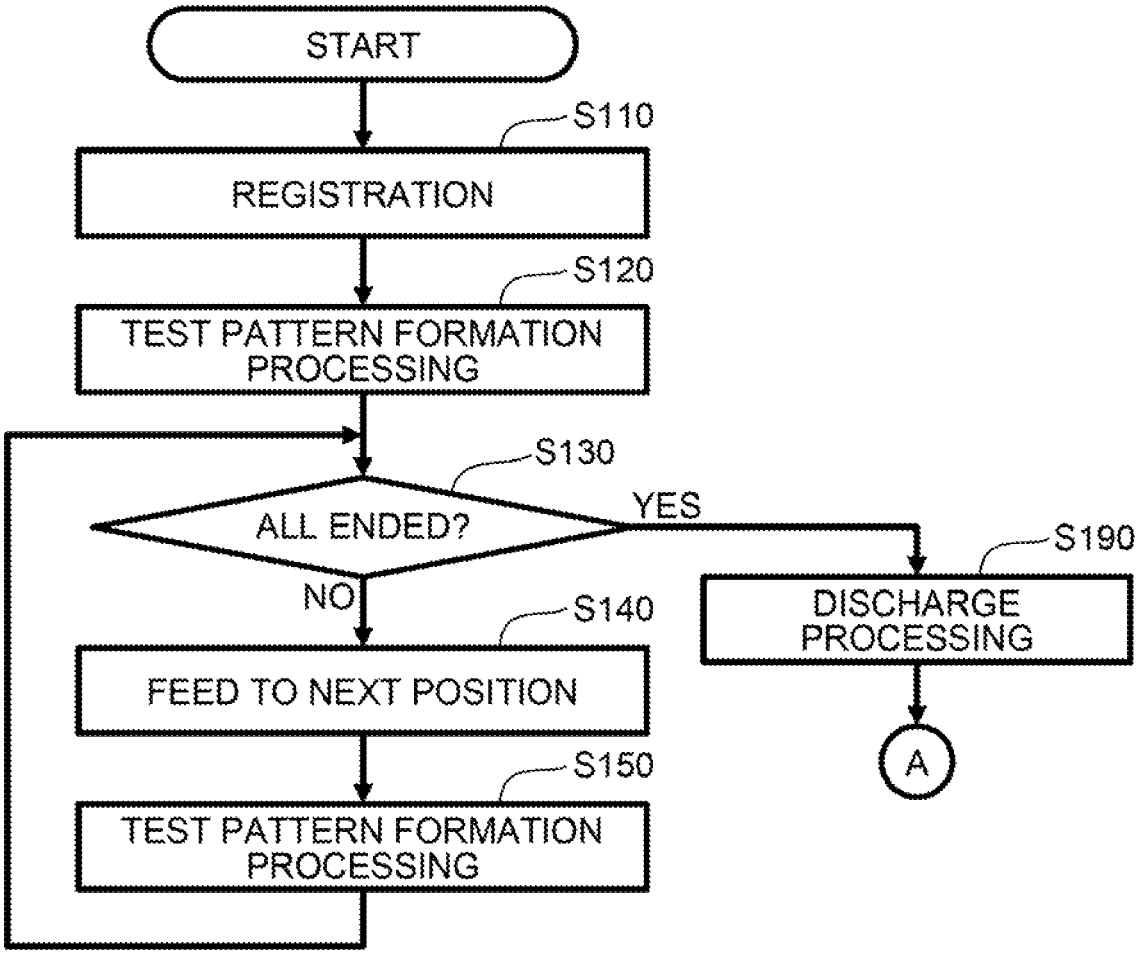
FIG. 4 is a flowchart illustrating text printing processing that is executed by a main controller.
Figure 5:
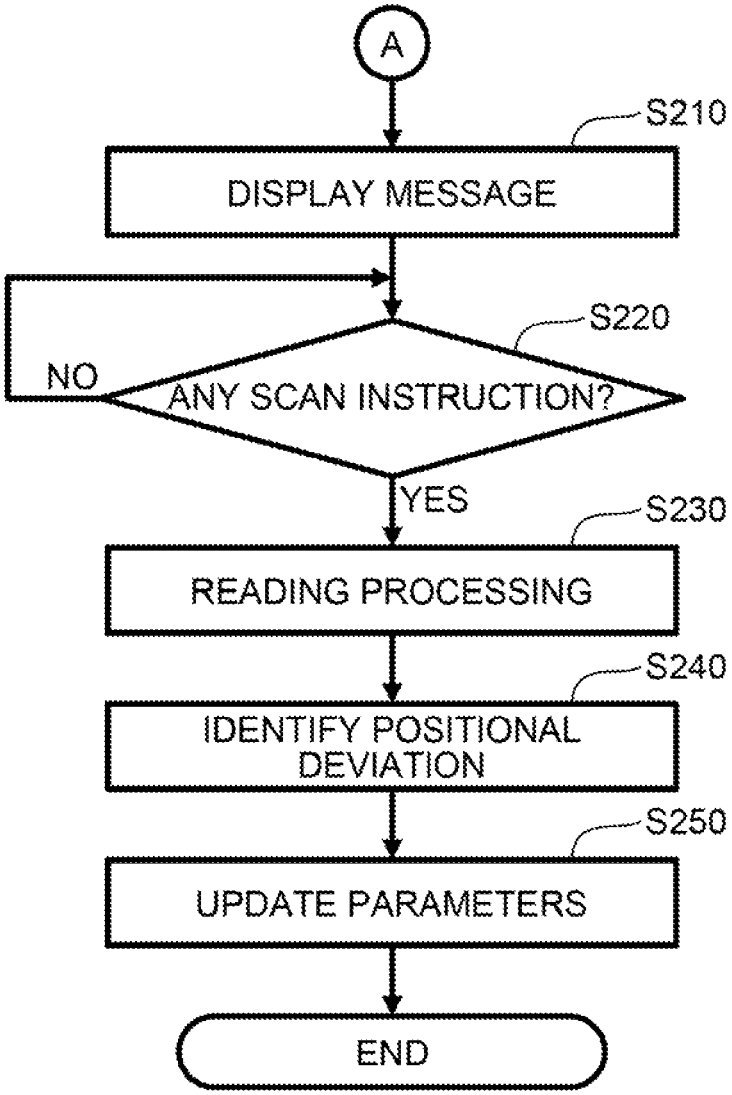
FIG. 5 is a flowchart illustrating test printing processing that is executed by the main controller.

Specifically, upon receiving input of a test pattern print command from the user interface 90 or external device 3, the main controller 10 executes the test printing processing illustrated in FIGS. 4 and 5 in accordance with a program stored in the ROM 13. For example, a user using the image forming system 1, or a worker at the manufacturer of the image forming system 1 before shipping, operates the user interface 90 or external device 3 to input the test pattern printing instruction.

When the test printing processing illustrated in FIG. 4 is started, the main controller 10 executes registration processing (S110). In the registration processing, the main controller 10 controls the PF motor 63 such that the sheet Q is conveyed by a predetermined amount by rotation of the conveyance roller 613 and discharge roller 617, and the sheet Q is situated in the recording region R0 below the recording head 40 (S110). Accordingly, the sheet Q is situated at a position for forming a test pattern.

It should be understood in the following description that references to the main controller 10 controlling or driving the recording head 40, CR motor 53, and/or PF motor 63, should be understood to mean that the main controller 10 controls or drives the recording head 40, CR motor 53, and/or PF motor 63 through the print controller 30. Controlling and driving through the print controller 30 is realized by the main controller 10 inputting a command to the print controller 30 for realizing this controlling and driving. Instructing operations include parameter setting operations performed with regard to the print controller 30.

Figure 6:
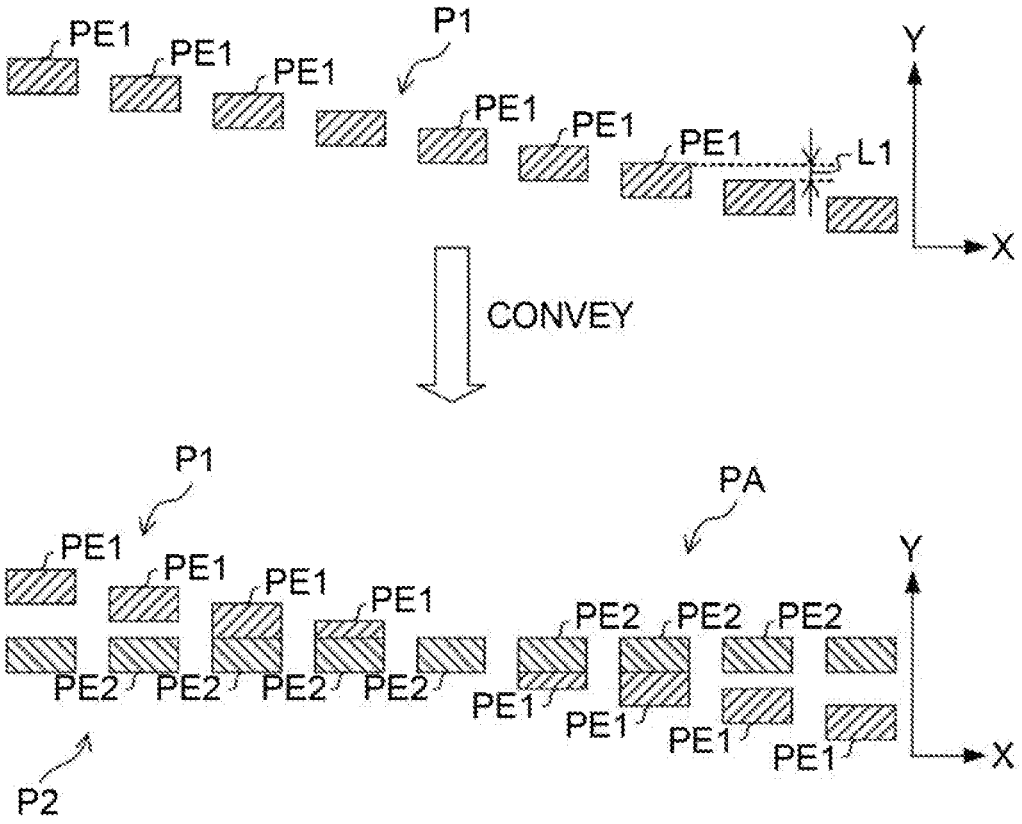
FIG. 6 is a diagram describing a test pattern formation form.

Upon ending the processing in S110, the main controller 10 executes test pattern formation processing (S120). In the test pattern formation processing, the main controller 10 controls the recording head 40, CR motor 53, and PF motor 63, such that a test pattern PA illustrated below in FIG. 6 is formed on the sheet Q.

The test pattern PA (below in FIG. 6) is an overlaid image of a first pattern image P1 and a second pattern image P2. The first pattern image P1 is indicated by hatching with lines slanting from the upper right to the lower left in FIG. 6, while the second pattern image P2 is indicated by hatching with lines slanting from the upper left to the lower right. It should be understood that these images are illustrated in this manner simply for illustrative purposes, and that the actual first and second pattern images P1 and P2 are solid monochrome images. In the test pattern formation processing (S120), the first pattern image P1 is formed using the first nozzle group N1 (see above in FIG. 6), and thereafter the second pattern image P2 is formed using the second nozzle group N2 (see below in FIG. 6).

The first pattern image P1 is made up of multiple first pattern elements PE1. The multiple first pattern elements PE1 in the first pattern image P1 are arrayed in a staggered manner slanted as to the main scanning direction, i.e., the X-axis direction. The second pattern image P2 is made up of multiple second pattern elements PE2. The multiple second pattern elements PE2 in the second pattern image P2 are arrayed in parallel as to the main scanning direction.

Figure 7:
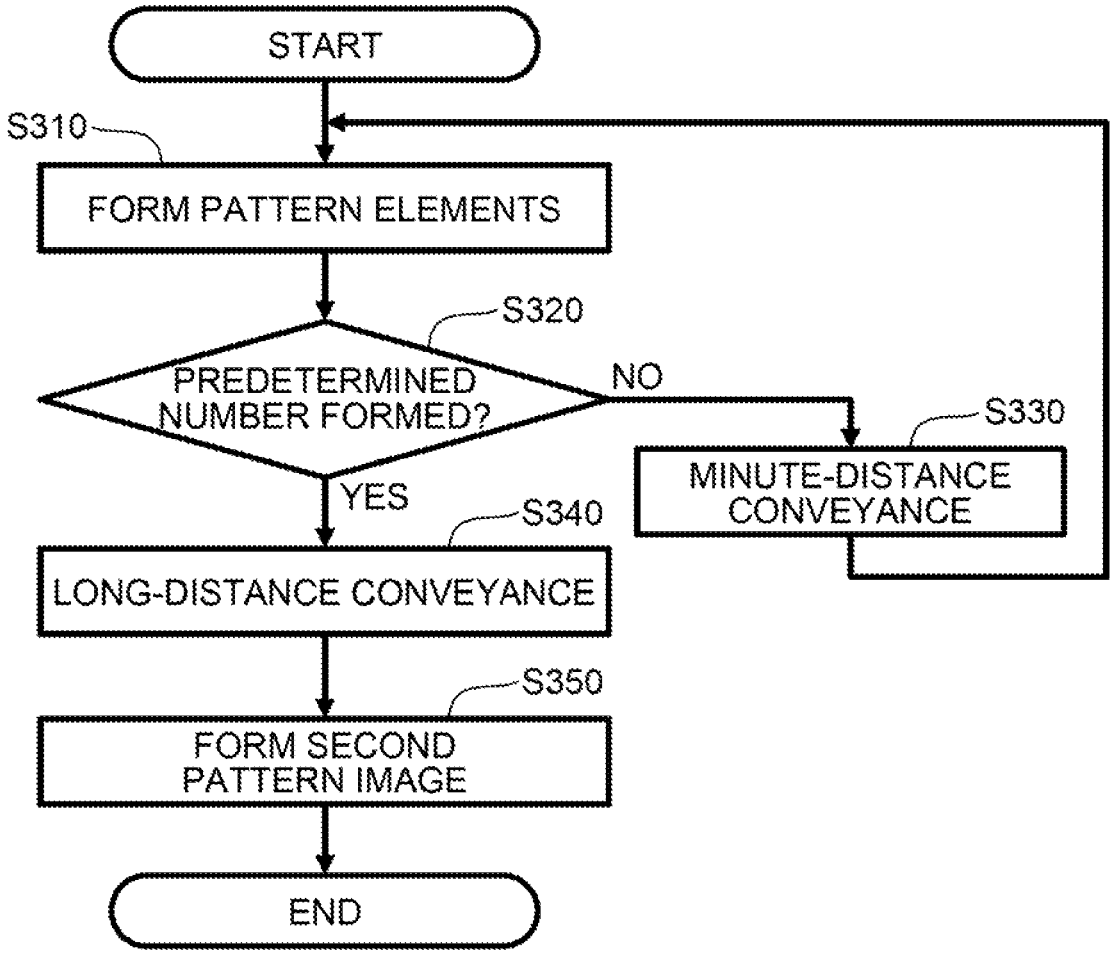
FIG. 7 is a flowchart illustrating test pattern formation processing according to a first embodiment.

Details of the test pattern formation processing executed in S120 are illustrated in FIG. 7. In this test pattern formation processing, the main controller 10 controls the recording head 40, CR motor 53, and PF motor 63, so that the first pattern image P1 is formed on the sheet Q, by repeatedly executing the processing of S310 through S330.

In S310, the main controller 10 controls the recording head 40 and CR motor 53 so that one first pattern element PE1 is formed on the stationary sheet Q by discharge of ink droplets from the first nozzle group N1. In S330, the PF motor 63 is driven such that the sheet Q is conveyed downstream by a minute distance L1.

The main controller 10 repeatedly executes the processing of S310 and S330 until a predetermined number of first pattern elements PE1 are formed on the sheet Q, thereby forming the first pattern image P1 on the sheet Q. It can thus be understood from the contents of the processing described above that the first pattern image P1 is formed by repeatedly alternating the operation of forming one first pattern element PE1 on the sheet Q and the operation of conveying the sheet Q by the minute distance L1.

Upon formation of the first pattern image P1 illustrated above in FIG. 6 being completed by forming a predetermined number of first pattern elements PE1 (Yes in S320), the main controller 10 transitions the flow to S340.

In S340, the main controller 10 controls the PF motor 63 so that the sheet Q is conveyed downstream by a predetermined distance L (S340). The predetermined distance L is the distance of one of the multiple first pattern elements PE1 being conveyed to a position facing the second nozzle group N2 at the downstream side of the recording head 40.

Specifically, in a case assuming that there is no conveyance error of the sheet Q, the predetermined distance L is a distance L where the first pattern element PE1 positioned at the center of the first pattern image P1 is completely overlaid by the second pattern element PE2. In a case where the number of first pattern elements PE1 in the first pattern image P1 is $$2\times M+1,$$

the predetermined distance L corresponds to distance $$L0-M\times L1.$$

Hereinafter, conveying of the sheet Q by the predetermined distance L described above will be referred to as "long-distance conveyance" of the sheet Q.

After performing long-distance conveyance of the sheet Q by controlling the PF motor 63, the main controller 10 controls the recording head 40 and CR motor 53 so that the second pattern image P2 is formed on the stationary sheet Q (S350).

In the processing in S350, the PF motor 63 is not rotated, and the sheet Q is maintained in a stopped state. While conveying the carriage 52 in the main scanning direction by control through the print controller 30, the main controller 10 causes liquid droplets to be discharged from the second nozzle group N2 of the recording head 40 so as to form the second pattern elements PE2 at positions in the main scanning direction at which the first pattern elements PE1 have each been formed. According to this control, the second pattern image P2 made up of the second pattern elements PE2 arrayed in a single row in the main scanning direction is formed on the sheet Q, thereby completing the test pattern PA.

Once the test pattern PA is formed in this way, the main controller 10 judges whether or not formation of all test patterns PA has been completed (S130). Test patterns PA are formed at multiple positions on the sheet Q in the test printing processing according to the present embodiment, in order to determine conveyance error of the sheet Q at each rotation phase $\phi$ of the conveyance roller 613. Thus, a predetermined number of test patterns PA are formed on the sheet Q.

In a case where the predetermined number of test patterns PA have been formed, the main controller 10 returns a positive judgement in S130 and advances the flow to S190. In a case where the predetermined number of test patterns PA have not been formed, the main controller 10 returns a negative judgement in S130 and advances the flow to S140.

In S140, the main controller 10 drives the PF motor 63 to convey the sheet Q to the next text pattern formation position. Then in S150, test pattern formation processing is performed in the same way as with the processing in S120, and the flow transitions to S130. Thus, the processing of S130 through S150 is repeatedly executed until the predetermined number of test patterns PA are formed. Once the predetermined number of test patterns PA have been formed, the flow advances to S190.

In S190, the main controller 10 executes control through the print controller 30 to discharge the sheet Q, on which the test patterns PA have been formed, to the discharge tray, thereby ending the test printing processing. Thereafter, the flow transitions to S210 (see FIG. 5).

In S210, the main controller 10 displays, on the display of the user interface 90, a message prompting the user to place the sheet Q on which the test patterns have been printed on the document table of the scanner unit 70 and to input a scan instruction. The flow then stands by until the scan instruction is input via the user interface 90 (S220).

Upon the scan instruction being input, the main controller 10 controls the scanner unit 70 to read the sheet Q on which the test patterns have been printed, and acquires read image data of the read image from the scanner unit 70 (S230).

Based on the read image data acquired from the scanner unit 70, the main controller 10 identifies a positional deviation E between the first pattern image P1 and second pattern image P2 in each test pattern PA formed on the sheet Q (S240). The positional deviation E here corresponds to an amount of positional deviation of the first pattern image P1 as to the second pattern image P2 in the sub-scanning direction, with the positional relationship between the first pattern image P1 and second pattern image P2 when the conveyance error of the sheet Q is zero as a reference.

Figure 8:
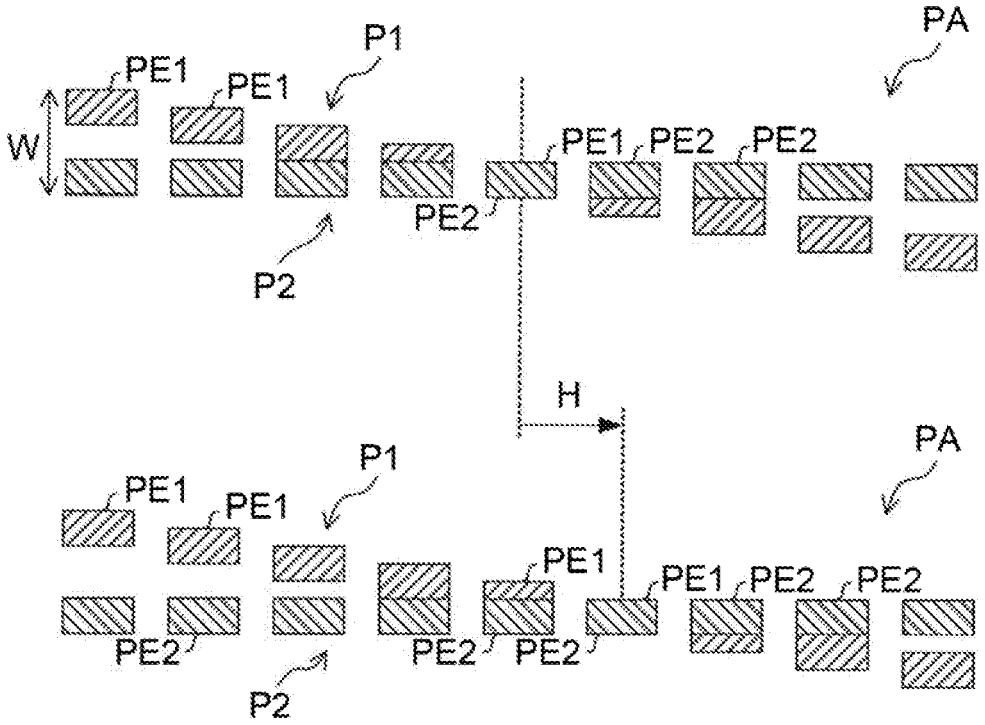
FIG. 8 is a diagram describing change in a test pattern due to conveyance error.

The test pattern PA above in FIG. 8 is a test pattern in a case where the conveyance error of the sheet Q is zero, the same as the test pattern PA below in FIG. 6. It can be seen from the example illustrated above in FIG. 8 that the first pattern element PE1 situated at the middle perfectly matches the position of the second pattern element PE2. The positional deviation E in this case is zero.

In comparison with this, the test pattern PA below in FIG. 8 exhibits conveyance error of the sheet Q of an amount equal to distance L1. That is to say, this is a test pattern where the positional deviation E=L1. In this test pattern PA, the first pattern element PE1 at the middle of the first pattern image P1, and the second pattern element PE2 at the middle of the second pattern image P2, are offset by distance L1. Instead, the first pattern element PE1 adjacent to the first pattern element PE1 at the middle perfectly matches the second pattern element PE2.

In S240, the main controller 10 uses the above-described phenomenon to search for a combination of a first pattern element PE1 and second pattern element PE2 that are most fully overlapping, for each test pattern PA in the read image data, and can thus calculate the positional deviation E based on a position H in the main scanning direction of the combination most fully overlapping. The position H here corresponds to a position in the main scanning direction as to a point of origin O set at the center of the first pattern image P1.

Figure 9:
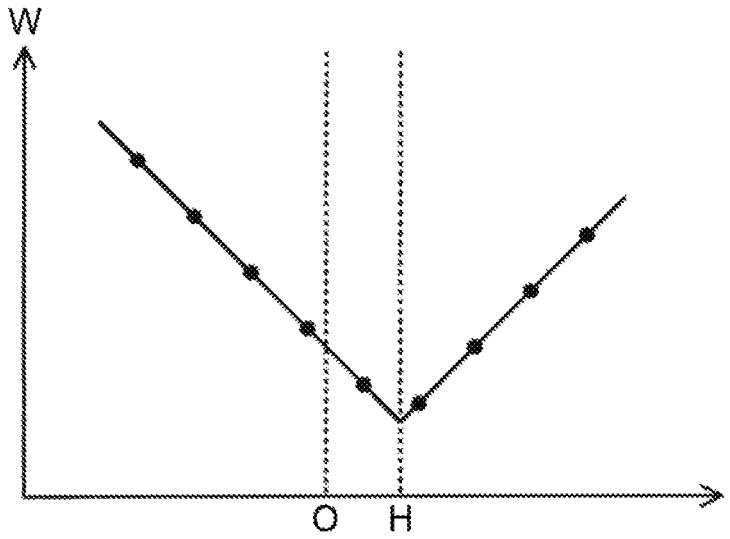
FIG. 9 is a diagram relating to function fitting.

Alternatively, the main controller 10 may calculate a distance W in the sub-scanning direction (see upper side in FIG. 8) between first pattern elements PE1 and corresponding second pattern elements PE2, for each first pattern element PE1. The main controller 10 then may identify the position H in the main scanning direction where the distance W is the smallest as illustrated in FIG. 9 by function fitting as to the distribution of these distances W, thereby identifying the positional deviation E.

Figure 10:
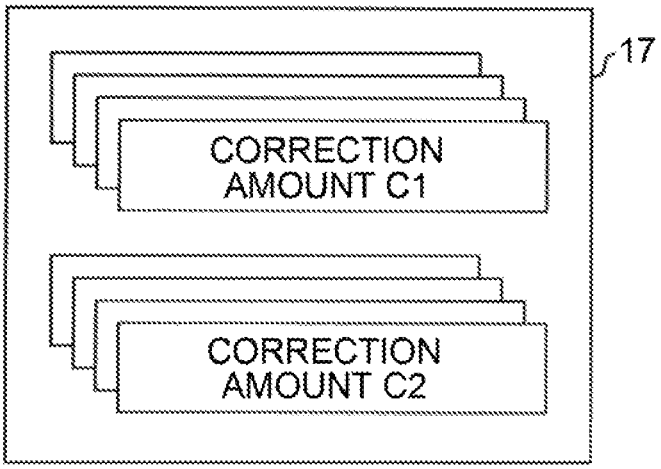
FIG. 10 is a diagram illustrating information to be stored.

Thus, the main controller 10 identifies the positional deviation E for each test pattern PA formed on the sheet Q, and determines the identified positional deviation E to be the conveyance error of the sheet Q. The main controller 10 subsequently updates the correction parameter group stored in the NVRAM 17, so that the conveyance error determined for each test pattern PA is set as a correction amount C1 for a target conveyance amount at a corresponding rotation phase ϕ of the conveyance roller 613 (S250). The correction parameter groups stored in the NVRAM 17 include a correction amount C1 for each rotation phase ϕ, as illustrated in FIG. 10. The main controller 10 updates the correction amount C1 to the positional deviation E identified in S240.

Figure 11:
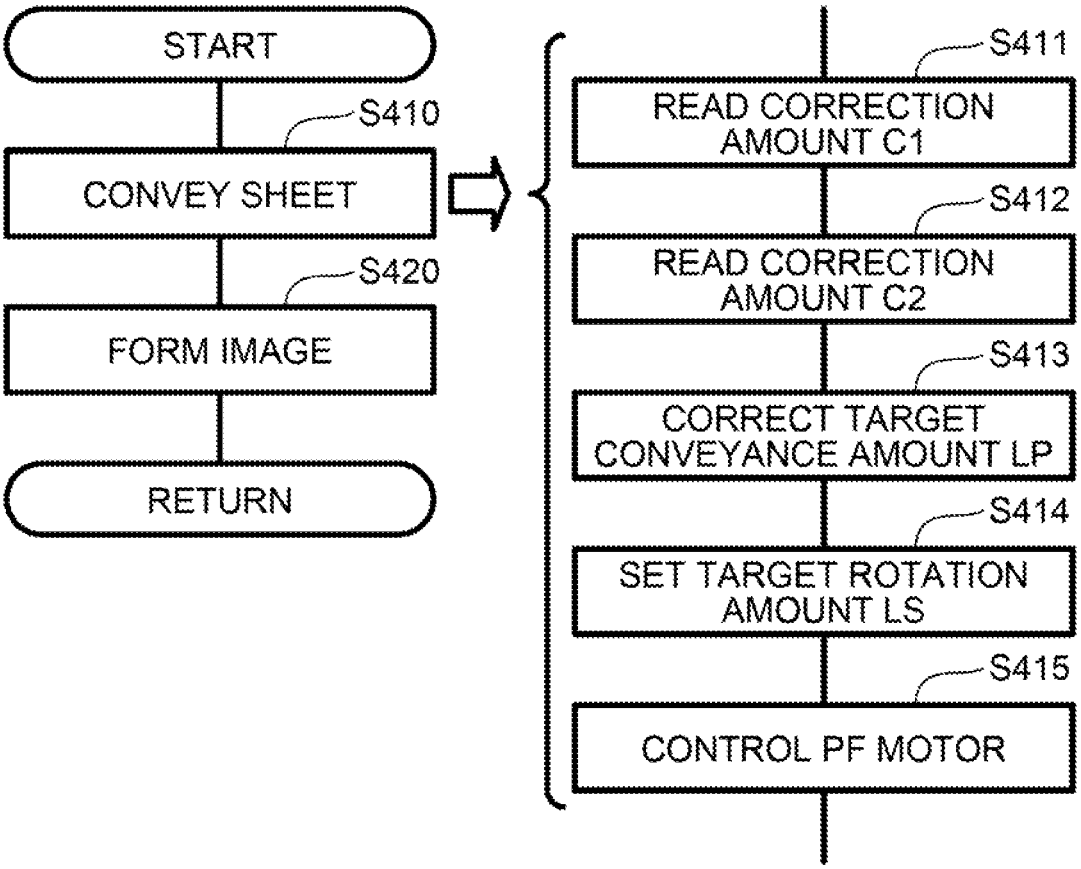
FIG. 11 is a flowchart illustrating image formation processing based on input image data.

When image data to be printed is input from outside or from the scanner unit 70, the main controller 10 executes processing to form this image data on the sheet Q in accordance with the printing conditions input along with the image data. Specifically, as illustrated in FIG. 11, the main controller 10 forms an image based on the image data to be printed on the sheet Q by alternately repeating processing of controlling the PF motor 63 to convey the sheet Q (S410) and processing of controlling the recording head 40 and CR motor 53 to form, on the sheet Q, part of the image based on the image data to be printed (S420).

In S410, the main controller 10 executes processing of reading out the correction amount C1 corresponding to the rotation phase ϕ of the conveyance roller 613 from the NVRAM 17 (S411), and processing of reading out a correction amount C2 from the NVRAM 17 that corresponds to conveyance conditions (S412).

The main controller 10 further executes processing of correcting a target conveyance amount LP of the sheet Q by the correction amount C1 and correction amount C2 that have been read out (S413), and processing of setting a target rotation amount LS for the conveyance roller 613 in accordance with the corrected target conveyance amount (LP−C1−C2) (S414). The main controller 10 executes processing of controlling the PF motor 63 so as to rotate the conveyance roller 613 by an amount equal to the target rotation amount LS set above (S415), thereby controlling the PF motor 63 to convey the sheet Q by an amount equal to the target conveyance amount LP.

The correction amount C2 read out in S412 is a correction amount determined beforehand by conveyance conditions such as the type of the sheet Q, the sheet conveyance amount immediately prior, the conveyance speed, and so forth. The NVRAM 17 stores the correction amount C2 for each of the conveyance conditions, as illustrated in FIG. 10. The correction amount C2 may be understood to be a correction amount for correcting conveyance error due to factors other than conveyance error of the sheet Q due to the structure of the conveyance roller 613.

In S412, the main controller 10 reads out the correction amount C2 for the conveyance conditions identified from the printing conditions. The printing conditions include conditions relating to printing mode, for example. Conveyance conditions such as the type of sheet Q, conveyance speeds, and so forth, differ in different printing modes, a fact that is commonly known.

According to the image forming system 1 of the present embodiment described above, when forming a test pattern PA, a first pattern image P1 involving minute-distance conveyance of the sheet Q is first formed, and thereafter long-distance conveyance of the sheet Q is performed, and a second pattern image P2 is formed. This formation method of the test pattern PA including these procedures enables the test pattern to be formed on the sheet Q with less influence of play of the power transmission mechanism 62, as compared to a conventional test pattern formation method where formation of a pattern image involving minute-distance conveyance is performed after the long-distance conveyance. As a result, influence of play of the power transmission mechanism 62 can be suppressed, and the correction parameter (C1) of conveyance error due to the structure of the conveyance roller 613 such as eccentricity and outer form, for example, can be updated with high accuracy.

Play of the power transmission mechanism 62, i.e., formation error in test patterns due to backlash among gears according to the present embodiment, is readily manifested immediately after the long-distance conveyance, which is to say at the early stages of minute-distance conveyance. The PF motor 63 is rotated by an amount smaller than the backlash in minute-distance conveyance, so there are cases where the PF motor 63 spins free at the early stages of minute-distance conveyance that is repeatedly performed.

The term "spins free" as used here means that the conveyance roller 613 or discharge roller 617 is not moving, i.e., the sheet is not moving, despite the PF motor 63 rotating. The "+L1" in FIG. 12 indicates that minute-distance conveyance is being performed by an amount equal to the distance L1. At the upper left in FIG. 12, the sheet Q is not moving due to the influence of backlash, even though minute-distance conveyance of "+L1" is performed, so adjacent first pattern elements PE1 are formed at generally the same position in the sub-scanning direction (Y-axis direction). The rectangles in FIG. 12 drawn using dotted lines indicate the positions of the first pattern elements PE1 in a case where there is no free spinning of the PF motor 63 due to backlash, while the hatched rectangular blocks in FIG. 12 indicate the positions of the first pattern elements PE1 influenced by free spinning.

Figure 12:
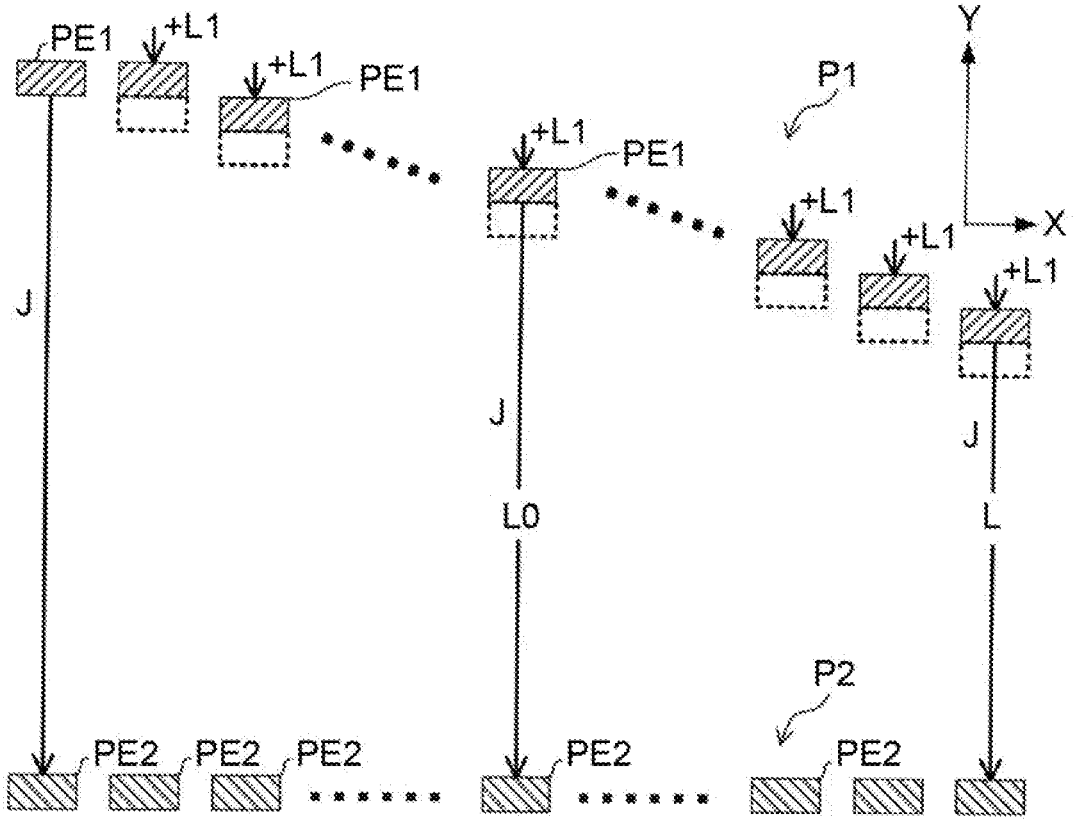
FIG. 12 is a diagram describing the effects of conveyance error in a case where minute-distance conveyance is executed beforehand.

A distance J indicated by an arrow in FIG. 12 represents a conveyance amount J of the sheet Q that occurs for each first pattern element PE1, from formation of the first pattern element PE1 until formation of the second pattern element PE2 corresponding to that first pattern element PE1.

Formation of each first pattern element PE1 included in the first pattern image P1 is performed including the influence of conveyance error δ of the sheet Q due to free spinning at the initial stage of minute-distance conveyance. In a case where long-distance conveyance is performed after the minute-distance conveyance, such as in the present embodiment, the influence of the conveyance error δ of the sheet Q due to the free spinning that has occurred at the initial stage of the minute-distance conveyance remains without change when forming the second pattern elements PE2. That is to say, each of the second pattern elements PE2 is also formed on the sheet Q including the influence of conveyance error δ due to free spinning at the initial stage of the minute-distance conveyance, and the degree thereof is the same as that of the first pattern elements PE1.

Accordingly, the conveyance amount J of the sheet Q from the first pattern elements PE1 being formed until the second pattern elements PE2 are formed does not include the conveyance error δ due to free spinning, except for the combination of the first pattern element PE1 formed first or at the initial stage of minute-distance conveyance and the corresponding second pattern element PE2 (the combination illustrated to the far left side in FIG. 12).

Figure 13:
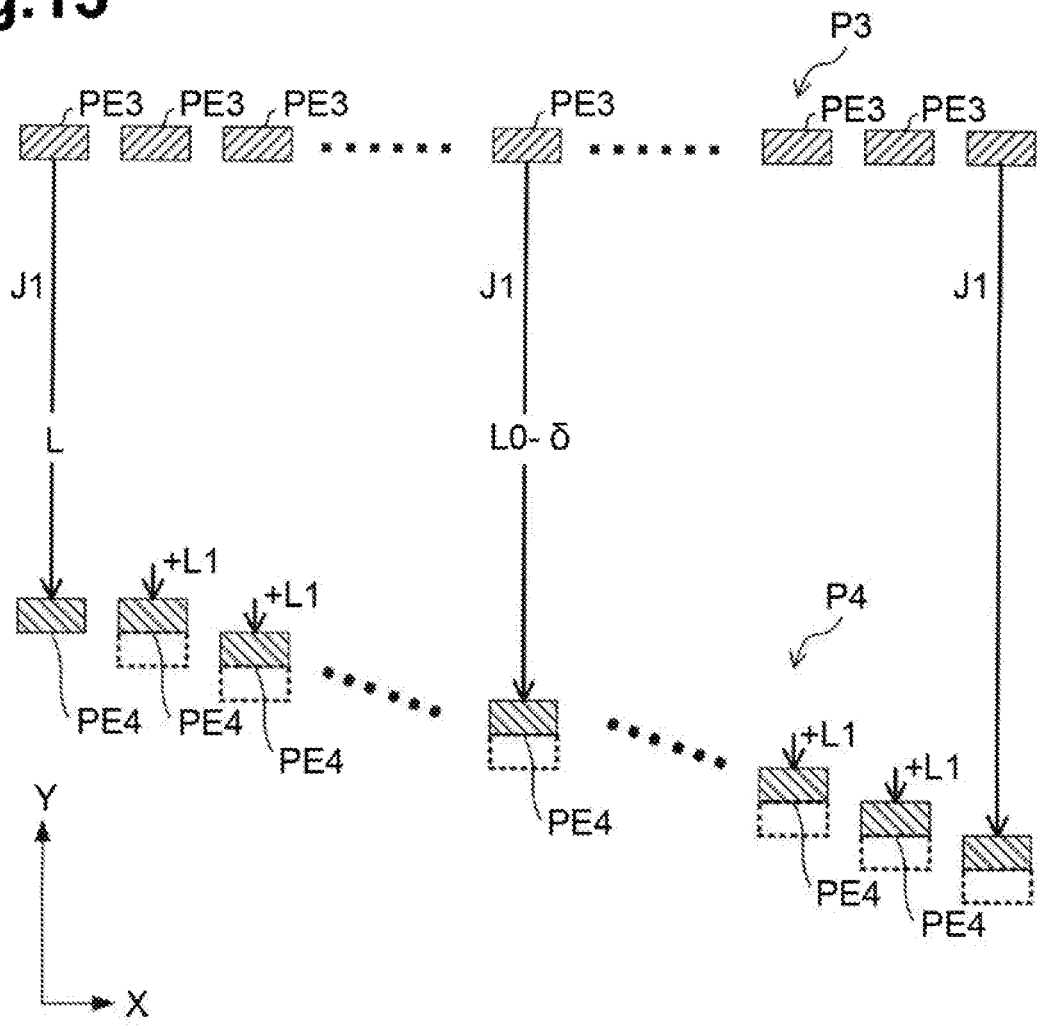
FIG. 13 is a diagram describing the effects of conveyance error in a case where minute-distance conveyance is executed afterwards.

In contrast with this, in the conventional test pattern formation method where formation of the pattern image involving minute-distance conveyance after the long-distance conveyance, the conveyance error δ due to free spinning in minute-distance conveyance occurs after the long-distance conveyance, so almost the entire test pattern is influenced by the conveyance error δ, as illustrated in FIG. 13.

The example illustrated in FIG. 13 shows a third pattern image P3 including multiple third pattern elements PE3 being formed without involving minute-distance conveyance in the same way as the second pattern image P2, and thereafter a fourth pattern image P4 including multiple fourth pattern elements PE4 being formed involving minute-distance conveyance in the same way as the first pattern image P1.

It can be seen from FIG. 13 that, with regard to each of the third pattern elements PE3, a conveyance amount J1 of the sheet Q from formation of the third pattern element PE3 to the formation of the fourth pattern element PE4 includes the conveyance error δ due to free spinning in all combinations of third pattern elements PE3 and fourth pattern elements PE4, with the exception of the combination of the third pattern element PE3 and fourth pattern element PE4 formed first without involving minute-distance conveyance.

Accordingly, the conveyance error of the sheet Q can only be identified from the test patterns in a way that includes the influence of backlash in the conventional test pattern formation method. On the other hand, the conveyance error of the sheet Q due to the structure of the conveyance roller 613 can be identified from test patterns in the present embodiment, with the influence of backlash suppressed as described above.

Thus, according to the present embodiment, the target conveyance amount LP can be corrected more appropriately than the conventional method when correcting the target conveyance amount LP using the correction amounts C1 and C2 for each factor. As a result, the quality of the image formed on the sheet Q can be improved.

Moreover, the combination of the first pattern element PE1 and second pattern element PE2 formed by minute-distance conveyance in the initial stage include the influence of conveyance error due to backlash, so the main controller 10 may operate to identify the positional deviation E while deeming this one combination to not exist in the test pattern PA.

That is to say, in S240 (see FIG. 5) the main controller 10 may calculate the distribution of distances W based on the layout of all first pattern elements PE1 included in the test pattern PA where the first pattern image P1 and the second pattern image P2 are overlaid, excluding a predetermined number of first pattern elements PE1 from the first pattern element PE1 first formed on the sheet Q, and the layout of second pattern elements PE2 corresponding thereto. The main controller 10 then may perform function fitting with regard to these distributions, and thereby identify the positional deviation E between the first pattern image P1 and second pattern image P2.

Setting and updating the correction amount C1 based on the positional deviation E identified in this way enables the target rotation amount LS to be corrected to reduce the conveyance error of the sheet Q with higher precision, whereby the quality of the image formed on the sheet Q can be improved.

Second Embodiment

The image forming system 1 according to a second embodiment forms test patterns according to the conventional technique in the first test pattern formation processing (S120). That is to say, formation of a pattern image involving minute-distance conveyance is performed after a pattern image not involving minute-distance conveyance is formed and long-distance conveyance is performed. The image forming system 1 according to the second embodiment is configured in the same way as the image forming system 1 according to the first embodiment except for the points described below.

The first test pattern formation processing (S120) according to the present embodiment is executed in a conveyance section regarding the sheet Q, where there is change from a state in which the leading edge of the sheet Q is situated further upstream from the discharge roller 617, illustrated above in FIG. 14, to a state in which the leading edge of the sheet Q passes the discharge roller 617 and is conveyed under force acting thereupon from both the conveyance roller 613 and the discharge roller 617, illustrated below in FIG. 14.

The second and subsequent test pattern formation processing (S150) is executed in a section in which the sheet Q is conveyed under force acting thereupon from both the conveyance roller 613 and the discharge roller 617, and a section in which the trailing edge of the sheet Q is situated further downstream from the conveyance roller 613, and where the sheet Q is conveyed under force acting thereupon from the discharge roller 617. In a certain time of test pattern formation processing (S150) that is performed multiple times, the first pattern image P1 is formed in a state where the sheet Q is conveyed under force acting thereupon from both the conveyance roller 613 and the discharge roller 617, and the second pattern image P2 is formed in a state where the trailing edge of the sheet Q has passed the conveyance roller 613.

In the second and subsequent test pattern formation processing (S150), the processing illustrated in FIG. 7 is executed in the same way as in the first embodiment. On the other hand, the processing illustrated in FIG. 15 is executed in the first test pattern formation processing (S120), thereby forming a test pattern PB made up of an overlaid image of a third pattern image P3 and a fourth pattern image P4, as illustrated in FIG. 16.

Figure 14:
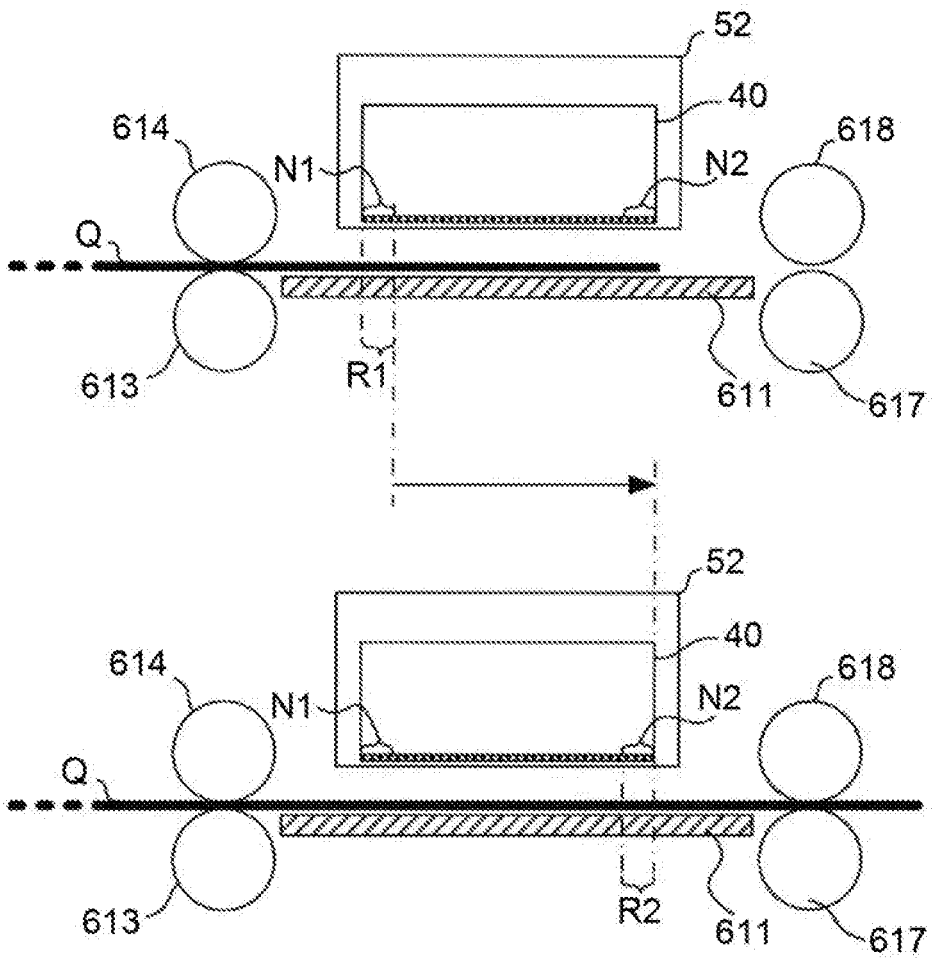
FIG. 14 is an explanatory diagram relating to conveyance sections.
Figure 15:
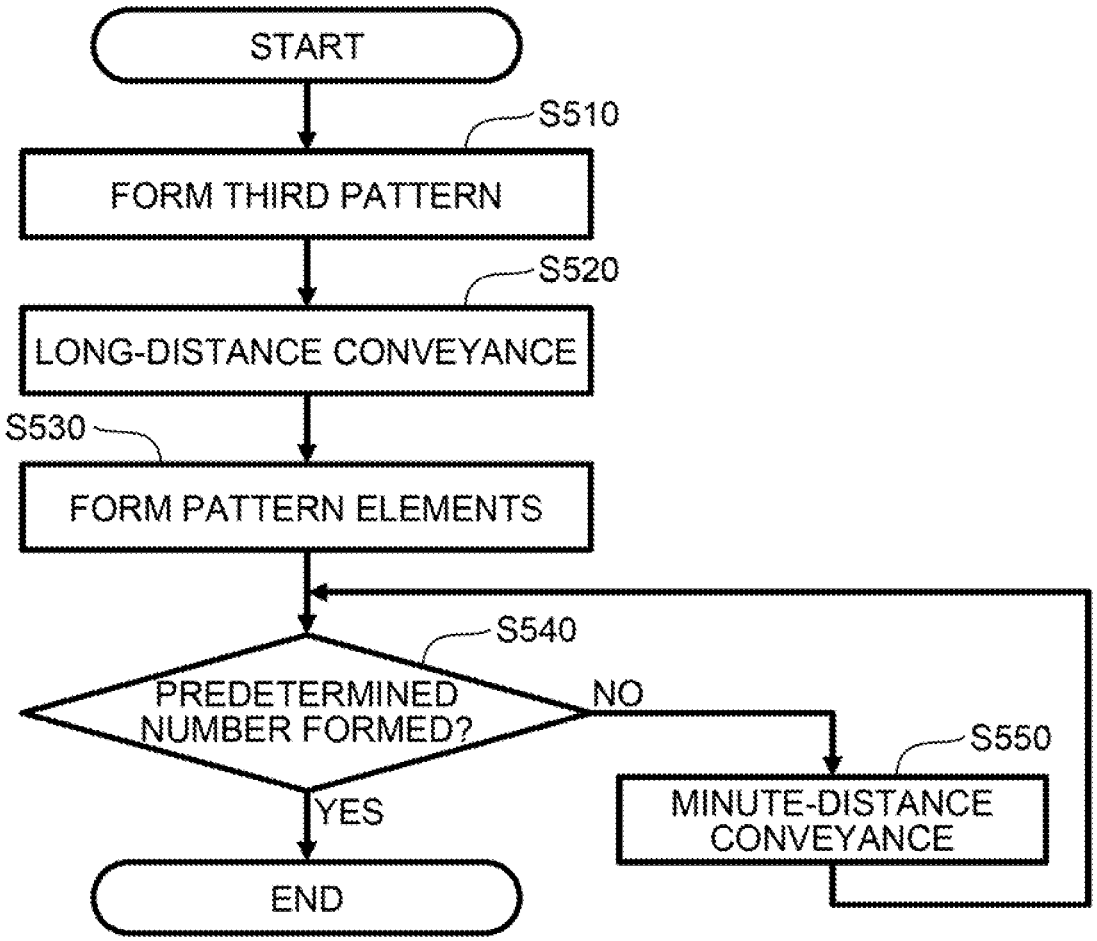
FIG. 15 is a flowchart illustrating test pattern formation processing according to a second embodiment.
Figure 16:
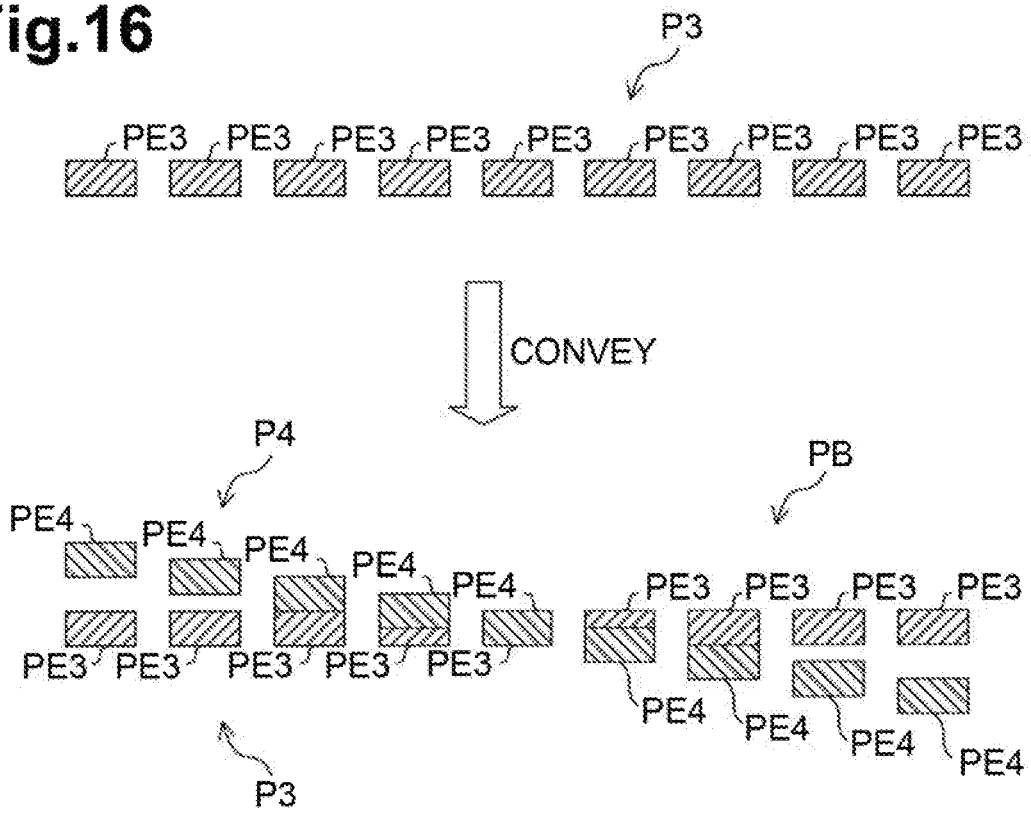
FIG. 16 is a diagram describing a test pattern formation form according to the second embodiment.

In the test pattern formation processing in FIG. 15, the main controller 10 controls the recording head 40 and CR motor 53 so that the third pattern image P3 is formed on the stationary sheet Q (S510). The third pattern image P3 is formed using the first nozzle group N1 in a state where the leading edge of the sheet Q is situated further upstream from the discharge roller 617, as illustrated above in FIG. 14. This processing forms the third pattern image P3 exemplarily illustrated above in FIG. 16 on the sheet Q.

Thereafter, the main controller 10 controls the PF motor 63 so that the sheet Q is conveyed downstream by the predetermined distance L (S520). The predetermined distance L is the distance of the third pattern image P3 being conveyed to a position facing the second nozzle group N2 at the downstream side of the recording head 40. Specifically, if there is no conveyance error of the sheet Q, the predetermined distance L is a distance L where the third pattern element PE3 positioned at the center of the third pattern image P3 is completely overlaid by the fourth pattern element PE4 positioned at the center of the fourth pattern image P4. In a case where the number of third pattern elements PE3 in the third pattern image P3 is $$2\times M+1,$$

this distance L corresponds to distance $$L0-M\times L1,$$

the same as in the first embodiment.

When the processing in S520 ends, the leading edge of the sheet Q passes the discharge roller 617, and the sheet Q is nipped at the nip of the conveyance roller 613 and discharge roller 617, as illustrated below in FIG. 14.

Thereafter, the main controller 10 repeatedly executes the processing of S530 through S550, thereby controlling the recording head 40, CR motor 53, and PF motor 63 so that the fourth pattern image P4 is formed on the sheet Q.

In S530, the main controller 10 controls the recording head 40 and CR motor 53 so that one fourth pattern element PE4 is formed on the stationary sheet Q by discharge of ink droplets from the second nozzle group N2. In S550, the PF motor 63 is driven such that the sheet Q is conveyed downstream by a minute distance L1.

The main controller 10 repeatedly executes the processing of S530 and S550 until as many fourth pattern elements PE4 as the number of third pattern elements PE3 that the third pattern image P3 has are formed on the sheet Q corresponding to the third pattern element PE3, thereby forming the fourth pattern image P4 on the sheet Q. Upon formation of the fourth pattern image P4 illustrated below in FIG. 16 being completed by forming a predetermined number of fourth pattern elements PE4 (Yes in S540), the main controller 10 ends the test pattern formation processing illustrated in FIG. 15.

In the present embodiment, the test pattern formation processing illustrated in FIG. 7 and the test pattern formation processing illustrated in FIG. 15 are switched between and executed, in accordance with the conveyance section of the sheet Q. If the processing illustrated in FIG. 7 is executed in a state where the leading edge of the sheet Q has not passed the discharge roller 617, there is a possibility that formation of the first pattern element PE1 in each minute-distance conveyance may be performed in a state where the sheet Q is unstable due to the leading edge of the sheet Q being a free edge. This can be a factor that lowers the determination accuracy of conveyance error.

On the other hand, according to the test pattern formation processing illustrated in FIG. 15, although there is conveyance error due to backlash included in the test pattern PB, conveyance error due to instability of the sheet Q is generally suppressed. Accordingly, test patterns PA and PB can be formed by methods appropriate for the conveyance sections of the sheet Q, correction of conveyance error can be appropriately performed, and good quality image formation can be performed on the sheet Q, according to the present embodiment.

Third Embodiment

Figure 17:
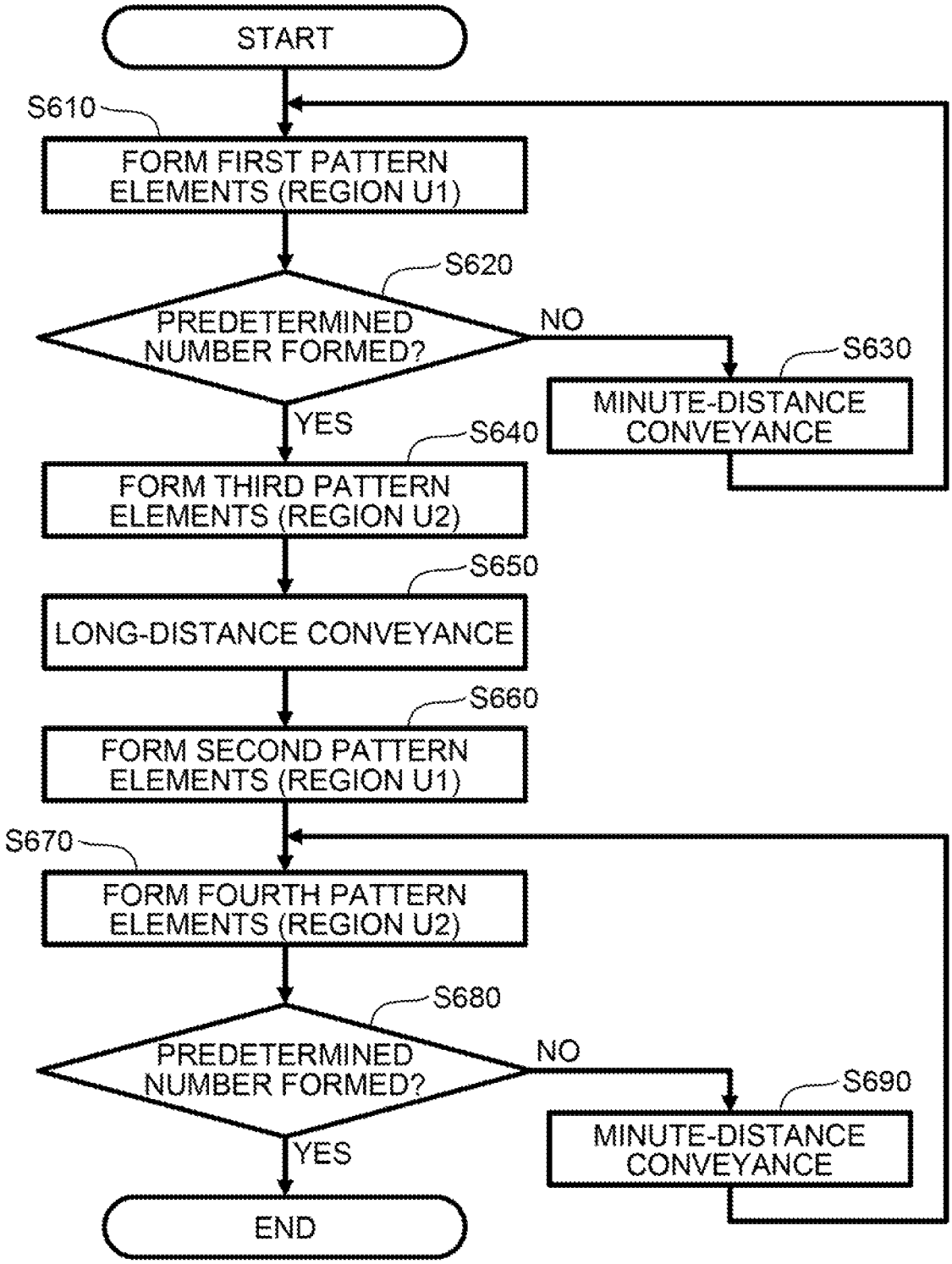
FIG. 17 is a flowchart illustrating test pattern formation processing according to a third embodiment.

In the image forming system 1 according to a third embodiment, the test pattern formation processing illustrated in FIG. 17 is executed at each of the test printing processing of S120 and S150 in FIG. 4, instead of the processing in FIG. 7. The image forming system 1 according to the third embodiment is configured in the same way as the image forming system 1 according to the first embodiment except for the points described below.

Figure 18:
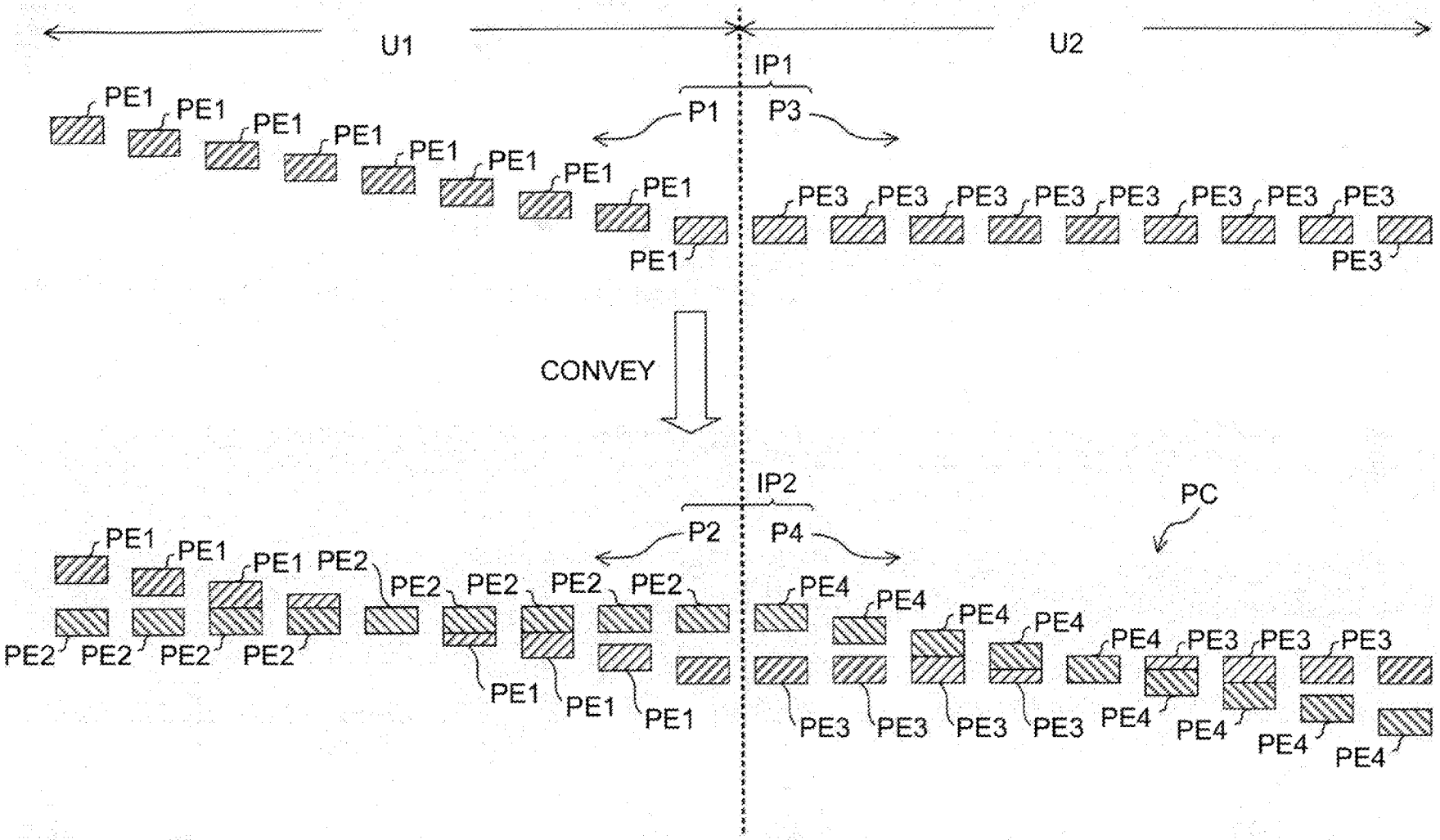
FIG. 18 is a diagram describing a test pattern formation form according to the third embodiment.

According to the present embodiment, a first integrated pattern image IP1 (see above in FIG. 18), which is a combination of the first pattern image P1 and third pattern image P3, is formed using the first nozzle group N1, by the main controller 10 executing the processing illustrated in FIG. 17. Thereafter, long-distance conveyance of the sheet Q is performed. Further, a second integrated pattern image IP2 (see below in FIG. 18), which is a combination of the second pattern image P2 and fourth pattern image P4, is formed using the second nozzle group N2. This forms a test pattern PC that is an overlaid image of the first integrated pattern image IP1 and the second integrated pattern image IP2 on the sheet Q. The test pattern PC corresponds to a test pattern where the above-described test patterns PA and PB are integrated.

When the processing in FIG. 17 starts, the main controller 10 controls the recording head 40, CR motor 53, and PF motor 63, so that the first pattern image P1 is formed on the sheet Q by discharge of ink droplets from the first nozzle group N1, by repeatedly alternately executing processing the same as that of S310 through S330 in S610 through S630.

Upon formation of a predetermined number of first pattern elements PE1 (Yes in S620), the main controller 10 controls the recording head 40 and CR motor 53 in a state where the sheet Q is stationary so that a group of third pattern elements PE3 is formed by discharge of ink droplets from the first nozzle group N1, in a region U2 adjacent to a region U1 where one group of first pattern elements PE1 has been formed in S610 through S630 (S640).

Thereafter, the main controller 10 controls the PF motor 63 so that the sheet Q is conveyed downstream by the predetermined distance L (S650). Further, the main controller 10 controls the recording head 40 and CR motor 53 so that the second pattern image P2 corresponding to the first pattern image P1 is formed on the stationary sheet Q (S660). That is to say, the main controller 10 controls the recording head 40 and CR motor 53 so that the second pattern elements PE2 corresponding to each of the first pattern elements PE1 are formed on the sheet Q by discharge of ink droplets from the second nozzle group N2 as to the sheet Q (S660).

Further, the main controller 10 repeatedly executes S670 through S690, in the same way as the processing of S530 through S550. That is to say, the main controller 10 controls the recording head 40, CR motor 53, and PF motor 63 so that the fourth pattern image P4 corresponding to the third pattern image P3 is formed on the sheet Q by discharging ink droplets from the second nozzle group N2.

Upon formation of the fourth pattern image P4 including the predetermined number of fourth pattern elements PE4 being completed (Yes in S680), the main controller 10 ends the test pattern formation processing illustrated in FIG. 17.

In the present embodiment, the main controller 10 acquires read image data corresponding to the above-described test pattern PC that is an overlaid image of the first integrated pattern image IP1 where the first pattern image P1 and third pattern image P3 have been integrated and the second integrated pattern image IP2 where the second pattern image P2 and fourth pattern image P4 have been integrated (S230). The main controller 10 analyzes this read image data, and identifies the positional deviation E between the first pattern image P1 and second pattern image P2 (E1) and the positional deviation E between the third pattern image P3 and fourth pattern image P4 (E2) for each test pattern PC.

A conveyance error K1 of the sheet Q due to the structure of the conveyance roller 613 is determined to be E1, and a conveyance error K2 of the sheet Q due to play (backlash) of the power transmission mechanism 62 is determined to be the difference between positional deviation E1 and positional deviation E2, i.e., |E1−E2| (S240).

As described above, the positional deviation E1 identified from the test pattern PA where minute-distance conveyance is executed first basically does not include components of the play of the power transmission mechanism 62. On the other hand, the positional deviation E2 identified from the test pattern PB where minute-distance conveyance is performed later basically includes components of play. Accordingly, the conveyance error K2 of the sheet Q due to play in the power transmission mechanism 62 can be determined from the difference between the positional deviations E1 and E2.

The main controller 10 sets the conveyance error K1 identified for each test pattern PC to the correction amount C1 at the corresponding rotation phase ϕ, and sets a representative value of the conveyance error K2 identified for each test pattern PC to the correction amount C2 for the corresponding conveyance conditions, and thus updates the correction parameter groups stored in the NVRAM 17 (S250). The representative value may be an average value or median value of the conveyance error K2 acquired from each of the multiple test patterns PC.

The main controller 10 can execute test printing processing under each of multiple conveyance conditions (see FIG. 4), to set and update the correction amounts C2 for each of the conveyance conditions stored in the NVRAM 17 based on the conveyance error K2 from the test patterns PC.

According to the present embodiment, the test pattern PC having the features of the first pattern image P1, second pattern image P2, third pattern image P3, and fourth pattern image P4 is formed on the sheet Q, whereby the conveyance error K1 due to the structure of the conveyance roller 613 and the conveyance error K2 due to play in the power transmission mechanism 62 are determined as conveyance error of the sheet Q, and the conveyance error of the sheet Q can be appropriately corrected based on these conveyance errors K1 and K2. Thus, the image forming system 1 that is capable of controlling sheet conveyance with high accuracy can be constructed according to the present embodiment.

Other Embodiments

The present disclosure is not restricted to the above-described embodiments; rather, various embodiments may be made. The technology according to the present disclosure is applicable to systems that perform image formation using systems other than the ink-jet system. Test patterns are not restricted to the configurations illustrated in the drawings. The test patterns illustrated in the drawings are simplified and conceptual illustrations for description, and are not intended to restrict features such as numbers, layouts, colors, sizes, and so forth, whatsoever. The rotary encoder 65 may be provided to the rotation shaft of the conveyance roller 613, or may be provided on the power transmission path from the PF motor 63 to the conveyance roller 613. In a case where the rotary encoder 65 is provided to the rotation shaft of the conveyance roller 613, the rotations of the conveyance roller 613 and the output of the rotary encoder 65 agree, but the rotations of the discharge roller 617 and the output of the rotary encoder 65 do not agree, so error relating to play in the power transmission mechanism is generated in the same way. The present disclosure can also suppress influence of such error as well.

Functions had by one component in the above embodiments may be distributed among multiple components. Functions had by multiple components may be integrated in one component. Part of the configurations in the above-described embodiments may be omitted. At least part of the configurations in the above-described embodiments may be added to or substituted in other configurations of the above-described embodiments. All forms included in the technical spirit specified in the language in the Claims are embodiments of the present disclosure.

What is claimed is:

1. A printer comprising:

a first roller;

a second roller;

a motor configured to drive the first roller and the second roller to convey a sheet in a conveyance direction from the first roller toward the second roller;

a head disposed between the first roller and the second roller in the conveyance direction, the head comprising a plurality of nozzles aligned in the conveyance direction, the plurality of nozzles comprising a first nozzle and a second nozzle positioned in a downstream side from the first nozzle in the conveyance direction; and a controller, when printing a test pattern for correcting a conveyance amount of the sheet, the test pattern comprising a first pattern and a second pattern, the controller is configured to:

control the head and the motor to print the first pattern comprising a plurality of first pattern elements on the sheet by alternately repeating:

ejecting at least one liquid droplet from the first nozzle toward the sheet to print only one of the first pattern elements on the sheet; and conveying the sheet in the conveyance direction by a first distance, after printing the first pattern on the sheet, control the motor to convey the sheet in the conveyance direction by a second distance where one of the first pattern elements of the first pattern faces the second nozzle during ejecting at least one liquid droplet from the second nozzle for one of a plurality of second pattern elements of the second pattern toward the sheet; and control the head to eject respective liquid droplets from the second nozzle toward the sheet to print the plurality of second pattern elements of the second pattern on the sheet without conveying the sheet between the printing of each of the second pattern elements of the second pattern, a respective first pattern element and the one of the plurality of second pattern elements being disposed at a same location in a direction orthogonal to the conveyance direction, wherein, during printing a test pattern comprising the first pattern, the second pattern, a third pattern and a fourth pattern, the controller is configured to:

if the sheet is positioned in a first conveyance section, control the head and the motor to print the first pattern and the second pattern on the sheet;

if the sheet is positioned in a second conveyance section, control the head to eject respective liquid droplets from the first nozzle toward the sheet to print a plurality of third pattern elements of the third pattern on the sheet without conveying the sheet between the printing of each of the third pattern elements of the third pattern;

after printing the third pattern on the sheet, control the motor to convey the sheet in the conveyance direction by a third distance where one of the third pattern elements of the third pattern faces the second nozzle;

control the head and the motor to print the fourth pattern, the fourth pattern comprising a plurality of fourth pattern elements, by alternately repeating:

ejecting at least one liquid droplet from the second nozzle toward the sheet to print one of the fourth pattern elements on the sheet; and conveying the sheet in the conveyance direction by the first distance.

2. The printer according to claim 1, wherein the plurality of nozzles comprises a first nozzle group comprising the first nozzle, and wherein the controller is configured to control the head to print the first pattern by ejecting the at least one liquid droplet from the first nozzle group.

3. The printer according to claim 1, wherein the plurality of nozzles comprises a second nozzle group comprising the second nozzle, and wherein the controller is configured to control the head to print the second pattern by ejecting the at least one liquid droplet from the second nozzle group.

4. The printer according to claim 1, wherein the plurality of nozzles comprises a first nozzle group comprising the first nozzle and a second nozzle group comprising the second nozzle, and wherein the controller is configured to control the head to print the first pattern by ejecting the at least one liquid droplet from the first nozzle group and the second pattern by ejecting the at least one liquid droplet from the second nozzle group.

5. The printer according to claim 1, wherein the controller is configured to:

after a leading edge of the sheet conveyed by at least one of the first roller and the second roller reaches the second roller and before a trailing edge of the sheet conveyed by at least one of the first roller and the second roller is passed through the first roller, control the head and the motor to print the first pattern on the sheet; and after the trailing edge of the sheet is passed through the first roller, control the head to print the second pattern on the sheet.

6. The printer according to claim 4, wherein the head comprises a nozzle array comprising the plurality of nozzles aligned in the conveyance direction, wherein the first nozzle group is positioned at a most upstream side of the nozzle array in the conveyance direction, and wherein the second nozzle group is positioned at a most downstream side of the nozzle array in the conveyance direction.

7. The printer according to claim 4, wherein the first nozzle group and the second nozzle group are spaced from each other in the conveyance direction.

8. The printer according to claim 1, wherein the first nozzle and the second nozzle are spaced from each other in the conveyance direction.

9. The printer according to claim 1, wherein the second distance is greater than the first distance.

10. The printer according to claim 1, wherein the plurality of second pattern elements correspond to the plurality of first pattern elements respectively; and wherein the controller is configured to:

control the head to print the test pattern comprising the first pattern and the second pattern, the first pattern and the second pattern overlap each other; and determine a position deviation between the first pattern and the second pattern based on a subset of the plurality of first pattern elements and a subset of the plurality of second pattern elements corresponding to the subset of the first pattern elements, wherein the plurality of first pattern elements are printed in order from a primary first pattern element to a final first pattern element, and wherein the subset of the plurality of first pattern elements comprises at least one first pattern element printed after at least the primary first pattern element is printed.

11. The printer according to claim 10, further comprising a memory, wherein the controller is configured to set a first correction amount corresponding to a rotation phase of the first roller based on the position deviation in the memory.

12. The printer according to claim 11, wherein the controller is configured to set a second correction amount corresponding to conveyance information related to a conveyance condition in the memory.

13. The printer according to claim 12, wherein the conveyance condition comprises at least one of a type of the sheet and a conveyance speed.

14. The printer according to claim 12, wherein the memory is configured to store a position deviation corresponding to each of a plurality of the rotation phases of the first roller.

15. The printer according to claim 14, wherein the controller is configured to set a first correction amount corresponding to each of the plurality of rotation phases of the first roller in the memory.

16. The printer according to claim 14, wherein the controller is configured to set one of a plurality of the first correction amounts for each of the plurality of rotation phases, and wherein, when receiving image data and conveyance information related to the conveyance condition, the controller is configured to:

select one of the plurality of first correction amounts in the memory based on the rotation phase of the first roller pair;

select one of a plurality of second correction amounts in the memory based on the received conveyance information; and control the head and the motor to print the image on the sheet based on the image data by controlling the motor based on the selected first correction amount and the selected second correction amount.

17. The printer according to claim 1, wherein, in a state that a leading edge of the sheet conveyed by at least one of the first roller and the second roller is reached or passed through the second roller and a trailing edge of the sheet conveyed by at least one of the first roller and the second roller does not reached the first roller, or in a state that the trailing edge of the sheet is passed through the first roller, the sheet is position in the first conveyance section, and wherein in a state that the leading edge of the sheet is passed through the first roller and the leading edge of the sheet is positioned at an upstream side of the second roller in the conveyance direction, the sheet is positioned in the second conveyance section.

18. The printer according to claim 1, further comprising:

a carriage on which the head is mounted; and a carriage motor configured to move the carriage in the direction orthogonal to the conveyance direction, wherein the controller is configured to:

control the head and the carriage motor to print the first pattern on a first area of the sheet;

after controlling the head and the carriage motor to print a final first pattern element of the first pattern on the first area of the sheet, control the head and the carriage motor to print a third pattern comprising a plurality of third pattern elements on a second area being adjacent to the first area in the direction orthogonal to the conveyance direction of the sheet without conveying the sheet between the printing of each of the third pattern elements of the third pattern;

after printing the third pattern on the second area of the sheet, control the motor to convey the sheet by a fourth distance;

control the head to eject at least one liquid droplet from the second nozzle toward the first area to print the second pattern on the sheet without conveying the sheet between the printing of each of the second pattern elements of the second pattern; and after printing the second pattern on the sheet, control the head to print a fourth pattern comprising a plurality of fourth pattern elements on the second area of the sheet by alternately repeating:

ejecting at least one liquid droplet from the second nozzle toward the sheet to print one of the fourth pattern elements on the sheet; and conveying the sheet in the conveyance direction by the first distance.

19. The printer according to claim 18, wherein the controller is configured to control the head to eject liquid droplets to print a test pattern on the sheet, wherein the test pattern comprises the first pattern, the second pattern, the third pattern and the fourth pattern, the first pattern and the second pattern overlap each other, the third pattern and the fourth pattern overlap each other, wherein the controller is configured to:

determine a first position deviation between the first pattern and the second pattern based on the first pattern elements and the second pattern elements of the test pattern;

determine a second position deviation between the third pattern and the fourth pattern based on the third pattern elements and the fourth pattern elements of the test pattern; and calculate a first conveyance deviation based on the determined first position deviation and the determined second position deviation.

20. The printer according to claim 19, wherein the controller is configured to calculate second conveyance deviation other than the first conveyance deviation based on the first position deviation.

21. The printer according to claim 20, further comprising a memory, wherein the controller is configured to:

set a plurality of first correction amounts respectively corresponding to rotation phases of the first roller based on the second conveyance deviation determined for each respective rotation phase of the plurality of rotation phases of the first roller; and set a plurality of second correction amounts corresponding to the conveyance conditions based on the first conveyance deviation determined for each of a plurality of respective conveyance conditions, wherein; when receiving image data and conveyance information related the conveyance condition, the controller is configured to:

select one of the plurality of first correction amounts in the memory based on the rotation phase of the first roller;

select one of the plurality of second correction amounts in the memory based on the received conveyance information; and control the head to print the image on the sheet based on the image data by controlling the motor based on the selected first correction amount and the selected second correction amount.

22. The printer according to claim 19, wherein, when calculating the first conveyance deviation, the controller is configured to calculate an absolute value of a value which is subtracted the second position deviation from the first position deviation as the first conveyance deviation.

23. The printer according to claim 10, wherein, when determining the position deviation between the first pattern and the second pattern, the controller is configured to:

calculate a distribution of distances between a respective first pattern element included in the subset of the plurality of first pattern elements and a corresponding second pattern element included in the subset of the plurality of second pattern elements in the conveyance direction; and determine the position deviation based on the distribution of distances.

* * * * *